United States Patent [19]

Kinoshita et al.

[11] Patent Number: 4,915,860

[45] Date of Patent: Apr. 10, 1990

[54] UREA-URETHANE GREASE COMPOSITION

[75] Inventors: Hirotugu Kinoshita; Makoto Sekiya; Masaru Mishima, all of Kawasaki, Japan

[73] Assignee: Nippon Oil Co., Ltd., Tokyo, Japan

[21] Appl. No.: 328,786

[22] Filed: Mar. 23, 1989

Related U.S. Application Data

[63] Continuation of Ser. No. 141,401, Jan. 4, 1988, abandoned.

[30] Foreign Application Priority Data

Jan. 9, 1987 [JP] Japan ..... 62-001763

[51] Int. Cl.[4] ..... C10M 115/08

[52] U.S. Cl. ..... 252/51.5 R; 252/51.5 A

[58] Field of Search ..... 252/51.5 R, 51.5 A

[56] References Cited

U.S. PATENT DOCUMENTS

| | | | |
|---|---|---|---|
| 2,710,840 | 6/1955 | Swakon et al. | 252/51.5 A |
| 3,096,285 | 7/1963 | Huttenlocher et al. | 252/51.5 A |
| 3,689,413 | 9/1972 | Loeffler | 252/51.5 A |
| 4,065,395 | 12/1977 | Bailey | 252/51.5 A |
| 4,102,797 | 7/1978 | Schadenberg | 252/51.5 A |
| 4,115,284 | 9/1978 | Kinoshita et al. | 252/51.5 A |

FOREIGN PATENT DOCUMENTS

| | | | |
|---|---|---|---|
| 5511156 | 11/1972 | Japan | 252/51.5 R |
| 88095 | 5/1985 | Japan . | |

*Primary Examiner*—William R. Dixon, Jr.
*Assistant Examiner*—Jerry D. Johnson
*Attorney, Agent, or Firm*—Darby & Darby

[57] ABSTRACT

A urea-urethane grease composition contains, as essential ingredients, a thickener and a lubricant base oil. The thickener contains a urea-urethane mixture having a composition including 20 to 99, mol. % of a diurea compound represented by the general formula (I) of

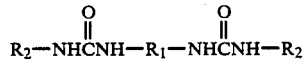

4 to 30 mol. % of a urea-urethane compound represented by the general formula (II) of

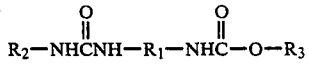

and 1 to 50 mol. % of a diurethane compound represented by the general formula (III) of

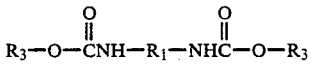

wherein $R_1$ represents a difunctional aromatic hydrocarbon residue having 6 to 15 carbon atoms, $R_2$ a cyclohexyl group or a group derived from cyclohexyl and having 7 to 12 carbon atoms and $R_3$ an alkyl group or an alkenyl group having 8 to 20 carbon atoms. The ratio of the numbers of amino groups $R_2$—NH— to those of alkoxy groups $R_3$—O— in the mixture being 95/5 to 40/60. The thickener is contained in an amount of 2 to 25 wt. % based on the total weight of the grease composition.

10 Claims, No Drawings

UREA-URETHANE GREASE COMPOSITION

This is a continuation of Ser. No. 141,401, filed 1/4/88, now abandoned.

BACKGROUND OF THE INVENTION

1. Field of the Invention

The present invention relates to a urea-urethane grease composition, i.e. a grease composition containing a urea-urethane compound as a thickener, and particularly to such a grease composition having excellent properties and having stability with extremely little tendency to harden over a long period of time.

2. Related Art Statement

With surprising progress of heavy chemical industries in recent years, a variety of apparatuses or machines is worked under severe conditions. Under such circumstances, lubricants must have superior properties to withstand the actual conditions used. Many investigations have hitherto been made to develop a numerous variety of lubricants. However, the apparatuses or machines used in the manufacturing industries have bearings which are often exposed to relatively high temperature of higher than 150° C. even under normal operating conditions. There is a case where a high loading is applied on a bearing which is operated at ultra low speed. One of the lubricants applied in-between the bearings for smooth operation of the machines is a grease composition.

Metallic soap thickeners are predominantly used as the thickeners for the greases. However, even a lithium soap grease, which is known as a universal grease, has a dropping point of about 200° C. and cannot be used at a temperature range of higher than 150° C.

A variety of thickeners has been proposed for use in grease compositions which can be used in a high temperature environment for a long time, the examples being various complex soaps, sodium terephthalamate, bentone and organic thickeners such as indanthrene. However, these thickeners known by the prior proposals have individual disadvantages. For example, calcium complex type compounds have a disadvantage that they tend to rapidly harden the grease. Sodium terephthalamate causes syneresis and separation of oil, or accelerates deterioration due to oxidation since it contains intramolecular metal atoms. Bentone is deterimental in lubricating property at high temperature for prolonged use, whereas indanthrene has bad hue and is expensive.

On the other hand, greases containing urea thickeners having various terminal groups include so-called diurea grease and tetraurea grease which have more advantageous merits over those used in the conventional greases described above. However, the tetraurea grease has disadvantages that the consistency thereof is decreased considerably as it is exposed to high temperature for a long time, and that it is hardened or softened, depending on the difference in shearing rate applied thereto, leading to adverse effects in practical use. Likewise, the known diurea greases containing diurea compounds having terminal groups merely composed of alkyl groups are low in dropping point to frequently separate oil at high temperature so that they cannot be used at a high temperature environment for a long time. On the other hand, the known diurea greases containing diurea compounds having terminal groups merely composed of aromatic hydrocarbon residues have a high dropping point but they are still unsatisfactory in connection with the problem of oil separation at high temperature, with a further disadvantage that the thickening capacities thereof are equivalent or even inferior to those having alkyl terminal groups. A still further problem involved in the known diurea grease containing a diurea thickener having aromatic terminal groups is that the aromatic amines used in preparation thereof have physiological toxicity to humans.

After eager investigation to overcome the problems of the aforementioned urea greases, we have found that the diurea compounds have properties well suited for use as the thickeners in greases, and that the terminal groups of the diurea compounds affect significant influence on the function of the diurea compounds. In detail, we have found a diurea compound which has superior properties when used as a thickener for a grease. The diurea compound has a cyclohexyl group or a group derived therefrom and having 6 to 12 carbon atoms or an alkyl group having 8 to 20 carbon atoms at either one of the terminal groups, the molar ratio of the cycloalkyl or derivatives thereof to the total molar equivalent of the cyclohexyl or derivatives thereof plus the alkyl group ranging from 20 to 90 mol %. The diurea grease containing the diurea compound was applied for patent and the application was published by Japanese Patent publication No. 11156/1980.

The diurea grease composition disclosed by Japanese Patent publication No. 11156/1980 has the following advantages.

(1) Change in consistency is small even after the use thereof at high temperature for a long time.
(2) It has excellent mechanical stability under shearing rates varying within a wide range.
(3) Separation of oil at high temperature is small.
(4) It has excellent water-resistant property.
(5) It exhibits powerful thickening capacity.

However, subsequent investigations on the diurea grease composition have revealed that the properties of the product fluctuate, depending on the difference in manufacturing conditions, so that the grease becomes too hard after the lapse of time when the manufacturing conditions for the product are impertinent.

Alternatively, in Japanese Laid-open Patent Publication No. 88095/1985, there is disclosed a sealing grease for a pallet sealing device of a sintering unit obtained by mixing into base oil a thickener comprised of a mixture of a diurea compound and a diurethane compound in a predetermined ratio.

As a result of our eager researches and investigations into the diurea grease disclosed in these prior-art publications, the present inventors have found that a urea-urethane grease composition obtained by mixing a diurea compound, a urea-urethane compound in which a part of the urea groups is substituted by urethane groups and a diurethane compound in a specific ratio as a thickener has highly satisfactory properties. This finding has led to fulfilment of the present invention.

OBJECTS AND SUMMARY OF THE INVENTION

Accordingly, a principal object of this invention is to provide a urea-urethane grease composition which has extremely little tendency of being hardened with the lapse of time, in addition to all of the excellent properties of the prior art diurea grease compositions.

A more specific object of this invention is to provide a urea-urethane grease composition having a high dropping point, excellent stability against oxidation and heating, and satisfactory water-resistant property.

A further object of this invention is to provide a urea-urethane grease composition having mechanical stability under conditions of being applied with shearing which varies within a wide range, the change in consistency after using for a long period of time being very small.

A still further object of this invention is to provide a urea-urethane grease composition containing a urea-urethane thickener which exhibits high thickening capacity so that only little oil separation is found in a high temperature environment.

With the aforementioned objects in view, the present invention provides a urea-urethane grease composition comprising, as essential ingredients, a thickener and a lubricant base oil, the thickener containing a urea-urethane mixture having a composition including 20 to 95 mol. % of a diurea compound represented by the general formula (I) of:

$$R_2-NHC(=O)NH-R_1-NHC(=O)NH-R_2 \quad (I)$$

4 to 30 mol. % of an urea-urethane compound represented by the general formula (II) of:

$$R_2-NHC(=O)NH-R_1-NHC(=O)-O-R_3 \quad (II)$$

and 1 to 50 mol. % of a diurethane compound represented by the general formula (III) of:

$$R_3-O-C(=O)NH-R_1-NHC(=O)-O-R_3 \quad (III)$$

wherein $R_1$ represents a difunctional aromatic hydrocarbon residue having 6 to 15 carbon atoms, $R_2$ a cyclohexyl group or a group derived from cyclohexyl and having 7 to 12 carbon atoms and $R_3$ an alkyl group or an alkenyl group having 8 to 20 carbon atoms, the ratio of the numbers of amino groups $R_2$—NH— to those of alkoxy groups $R_3$—O— in the mixture being 95/5 to 40/60, the thickener being contained in an amount of 2 to 25 wt. % based on the total weight of the grease composition.

DESCRIPTION OF THE INVENTION

The present invention will be described in further detail.

The thickener contained the urea-urethane grease composition of the present invention is a mixture of 20 to 95 mol. % and preferably 30 to 80 mol. % of a diurea compound represented by the general formula (I) of $$R_2-NHC(=O)NH-R_1-NHC(=O)NH-R_2,$$

4 to 30 mol. % and preferably 10 to 30 mol. % of a urea-urethane compound represented by the general formula (II) of $$R_2-NHC(=O)NH-R_1-NHC(=O)-O-R_3$$

and 1 to 50 mol. % and preferably 10 to 40 mol. % of a diurethane compound represented by the general formula (III) of $$R_3-O-C(=O)NH-R_1-NHC(=O)-O-R_3.$$

The thickener wherein any of the above numerical ranges is not satisfied, is not desirable since the capacity of the thickener in increasing the consistency is undesirably lowered.

In the general formulae (I)-(III), $R_1$ is a difunctional aromatic hydrocarbon residue having 6 to 15 carbon atoms, the particularly preferred examples being:

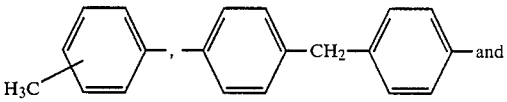

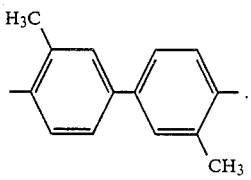

However, $R_1$ may be another difunctional aromatic hydrocarbon residue to provide a urea-urethane grease composition excellent in stability against heating and oxidation. In the general formulae (I) and (II), $R_2$ stands for a cyclohexyl group or a group derived from cyclohexyl and having 7 to 12 carbon atoms. Specific examples of a cyclohexyl group or a group derived from cyclohexyl and having 7 to 12 carbon atoms are cyclohexyl, methylcyclohexyl, dimethylcyclohexyl, ethylcyclohexyl, diethylcyclohexyl, propylcyclohexyl, isopropylcyclohexyl, 1-methyl-3-propylcyclohexyl, butylcyclohexyl, amylcyclohexyl, amyl-methylcyclohexyl and hexylcyclohexyl. Particularly preferred are cyclohexyl and a group derived from cyclohexyl and having 7 to 8 carbon atoms, such as methylcyclohexyl and ethylcyclohexyl. In the general formulae (II) and (III), $R_3$ stands for an alkyl or alkenyl group having 8 to 20 carbon atoms, the specific examples being alkyl and alkenyl groups having straight chain or side chain structures, such as octyl, nonyl, decyl, undecyl, dodecyl, tridecyl, tetradecyl, pentadecyl, hexadecyl, heptadecyl, octadecyl, octadecinyl, nonadecyl, eicosyl, octenyl, nonenyl, decenyl, undecenyl, dodecenyl, tridecenyl, tetradecenyl, pentadecenyl, hexadecenyl, hepatadecenyl, octadecenyl, nonadecenyl and eicosenyl. Particularly preferred examples are alkyl and alkenyl groups having straight or side chain structures and having 16 to 19 carbon atoms, such as hexadecyl, heptadecyl, octadecyl, octadecinyl, nonadecyl, hexadecenyl, heptadecenyl, octadecenyl and nonadecenyl. Although a urea-urethane compound represented by the general formula (II) and a diurethane compound represented by the general formula (III) containing an alkyl or alkenyl group having more than 20 carbon atoms may be used in the present invention, such a compound is relatively expensive and the use thereof is not preferred from the economical standpoint of view.

According to a particularly important aspect of this invention, the terminal groups in the urea-urethane mixture including a diurea compound, a urea-urethane compound and diurethane compound should be contained in the ratio defined in the claims. More specifically, an amino group of $R_2$—NH— and/or an alkoxy group of $R_3$—O— should be present in either one or both terminal groups in any of the compounds, and the ratio of the numbers of the amino groups to those of the alkoxy groups should range from 95/5 to 40/60, preferably from 85/15 to 60/40. If the ratio of the numbers of the amino groups to those of the alkoxy groups is less than 40/60, the grease is unstable in shearing, whereas the thickening capacity of the thickener is lowered if the ratio of the numbers of the amino groups to those of the alkoxy groups exceeds 95/5. As the thickening capacity is lowered, a larger quantity thereof must be added for thickening the grease to result in increase in production cost.

In the grease composition of this invention, a variety of petroleum and synthetic lubricant oils may be used as the base oil. Although a proper base oil may be selected in view of the specific application, lubricant oils extracted from petroleum are generally more favourable from the economical standpoint of view. The viscosity of the base oil is not critical, and any lubricant oils having viscosities within ordinary range may be used in the present invention. Particularly preferred viscosity range of the lubricant base oil is from 2 to 40 cSt at @210° F.

The thickener of the urea-urethane grease composition of the present invention that is, the mixture of the diurea compound, the urea-urethane compound and the diurethane compound, may be produced in any desired manner, for example, by reacting a diisocyanate represented by the general formula of OCN—$R_1$—NCO and a primary amine represented by the general formula of $R_2$—NH to produce a diurea compound, separately reacting a diisocyanate, a primary amine and a higher alcohol represented by the general formula $R_3$—OH to produce a urea-urethane compound, further separately reacting a diisocyanate and a higher alcohol to produce a diurethane compound and subsequently mixing these compounds to produce the desired mixture. Usually, however, a diisocyanate, a primary amine and a higher alcohol may be reacted to produce the mixture in one step.

In detail, a primary amine $R_2$—$NH_2$ (cyclohexylamine or a derivative thereof) is mixed with a higher alcohol $R_3$—OH in a mixing ratio so that the molar ratio of the primary amine to the higher alcohol is 95/5 to 40/60, and the thus obtained mixture is reacted with a diisocyanate. The reaction between the diisocyanate and the mixture of a primary amine and a higher alcohol may proceed in the presence of a volatile solvent, such as benzene, toluene, xylene, hexane, naphtha, diisobutyl ether, carbon tetrachloride and petrolium ether, or in the presence of a lubricant base oil which serves as a solvent, at a reaction temperature of preferably from 10° to 200° C. The reaction mixture may be agitated intimately in order to produce a uniform urea-urethane compound. In lieu of adding a mixture of a primary amine and a higher alcohol to a diisocyanate at one time, a primary amine and an alcohol may be added separately to the diisocyanate at several steps.

An appropriate amount of a lubricant base oil is added to the thus prepared thickener to prepare a grease composition. The volatile solvent is removed prior to the addition of the lubricant base oil when such a solvent is used at the step of preparing the thickener. However, when a lubricant base oil is used as the solvent at the step of preparing the thickener, the lubricant base oil may be contained in the product grease composition without being removed.

To the urea-urethane grease composition of the present invention there may be added an additive for further improving the properties thereof without impairing the advantageous characteristic features thereof. For example, to the grease composition of this invention there may be added another thickener, an extreme pressure additive, an antioxidant, an oiliness improver, a rust inhibitor and a viscosity index improver to improve the performance characteristics of the resultant grease composition.

The content of the urea-urethane mixture acting as the thickener in the urea-urethane grease composition of this invention should range from 2 to 25 wt %, preferably from 3 to 20 wt %, based on the total weight of the composition. If the content of the urea-urethane mixture is less than 2 wt %, the thickening capacity by the urea-urethane mixture is unsatisfactory. On the contrary, if the content of the urea-urethane mixture is more than 25 wt %, the resultant grease composition becomes too hard so as not to exhibit sufficient lubricating effect.

EXAMPLES OF THE INVENTION

The present invention will now be described more specifically with reference to some examples thereof. However, it should be noted here that the following examples are given by way of example only and thus the invention should not be limited only to the following examples.

EXAMPLE 1

40.3 g of 2,4-2,6-tolylenediisocyanate was added to 100 g of a mineral oil (10.5 cSt at @210° F.), and dissolved uniformly at the room temperature to prepare a first mixture. Separately, 32.1 g of cyclohexylamine and 37.6 g of octadecyl alcohol were mixed and dissolved in 390 g of the same mineral oil to prepare a second mixture. The second mixture was admixed with the first mixture under vigorous agitation, whereupon a thickened admixture was formed instantaneously. After agitating at the room temperature for additional 30 minutes and then heating to 100° C., the thickened mass was passed through a roll mill to obtain a product grease. The relative ratio of the diurea compound represented by the general formula of

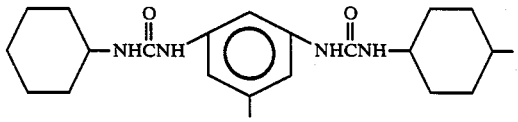

the urea-urethane compound represented by general formula of

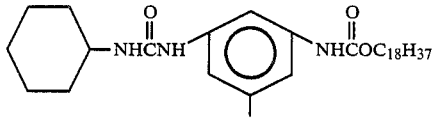

and the diurethane compound represented by the general formula of

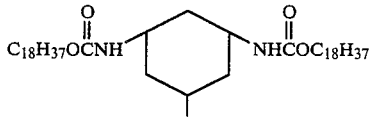

was 60 mol. %, 20 mol. % and 20 mol. %, respectively. The thus produced grease composition contained 11 wt % of a urea-urethane mixture acting as a thickener, in which the ratio of cyclohexylamino group to octadecyloxy group was 70/30.

The thus produced urea-urethane grease was subjected to the following tests to appraise the properties thereof, the results being shown in Table 1.

Tests for Appraisal of Properties of the Grease

Consistency: The worked consistencies (U/W and U/W after the lapse of one week from the production) and the unworked consistencies (60W and 100,000W) were determined generally in accordance with the JIS K 2220 5.3 Method.

Dropping Point: The dropping point was determined generally in accordance with the Test for Dropping Point stipulated by JIS K 2220 5.4 Method.

Oil Separation: The oil separation was determined generally in accordance with the Test for Oil Separation stipulated by JIS K 2220 5.7 Method, under the condition of 150° C. x 200 hours.

EXAMPLE 2

65.7 g of diphenylmethane-4,4'-diisocyanate was added to 400 g of a mineral oil (10.5 cSt at @210° F.), and dissolved uniformly by heating to 60° C. to obtain a first mixture. 49 g of dodecyl alcohol was dissolved in 200 g of the same mineral oil by heating to obtain a second mixture. The second mixture was added to the first mixture under vigorous agitation, and further a third mixture containing 49.4 g of cyclohexylamine dissolved in 280 g of the same mineral oil was added and again agitated vigorously, whereupon a thickened admixture was obtained. After continuing agitation for additional 30 minutes at 100° C., the admixture was passed through a roll mill to obtain a product grease. The relative ratio of the diurea compound represented by the general formula of

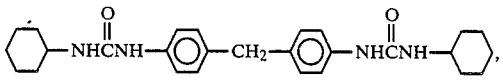

the urea-urethane compound represented by the general formula of

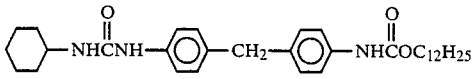

and the diurethane

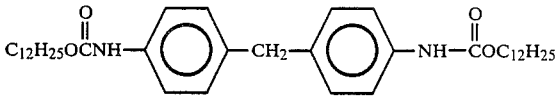

was 92 mol. %, 6 mol. % and 2 mol. %, respectively. The thus produced grease composition contained 12 wt % of a urea-urethane mixtures acting as a thickener, in which the ratio of cyclohexylamino group to dodecyloxy group was 95/5.

The thus produced urea-urethane grease was subjected to the tests to appraise the properties thereof, the results being shown in Table 1.

EXAMPLE 3

51.5 g of bitolylenediisocyanate was dissolved uniformly in 500 g of poly-α-olefin oil (8.2 cSt at @210° F.) at 70° C. to prepare a first mixture. Separately, 15.4 g of cyclohexylamine and 63.1 g of octyl alcohol were mixed uniformly with 370 g of the same poly-α-olefin oil to prepare a second mixture. The first and second mixtures were admixed together and agitated vigorously, whereupon a thickened admixture was obtained. After agitating for 30 minutes, the temperature of the admixture was raised to 120° C. and then passed through a roll mill to obtain a product grease composition. The relative ratio of the diurea compound represented by the general formula of

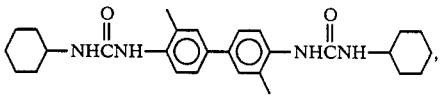

the urea-urethane compound represented by the general formula of

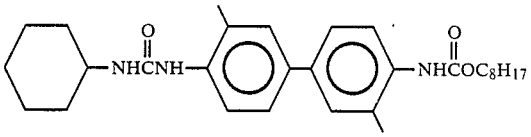

and the diurethane compound represented by the general formula of

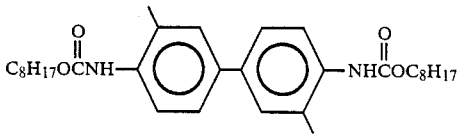

was 26 mol. %, 28 mol. % and 46 mol. %, respectively. The thus produced grease composition contained 13 wt % of a urea-urethane mixture acting as a thickener, in which the ratio of cyclohexylamino group to octyloxy group was 40/60.

The thus produced urea-urethane grease was subjected to the tests to appraise the properties thereof, the results being shown in Table 1.

COMPARATIVE EXAMPLES 1 AND 2

For comparison purpose, a commercially available Li-soap grease (Content of Thickener: 9 wt %; Comparative Example 1) and a commercially available tetraurea grease (Content of Thickener: 12.5 wt %; Comparative Example 2) were subjected to the same tests for appraisal of the properties thereof. The results are shown in Table 1.

COMPARATIVE EXAMPLE 3

8.09 g of diphenylmethane-4,4'-diisocyanate was added to 120 g of a mineral oil (10.5cSt at @210° F.), and heated to 60° C. to be dissolved uniformly to obtain a first mixture. Separately, 8.70 g of octadecylamine and 3.20 g of cyclohexylamine were dissolved in 60 g of the same mineral oil by heating to obtain a second mixture. The second mixture was admixed to the first mixture under vigorous agitation, whereupon a thickened mass was formed instantaneously. After continuing agitation for 30 minutes at 100° C., the thickened mass was passed through a roll mill to obtain a product grease. The thus produced grease contained 10 wt % of a diurea compound acting as a thickener, in which the ratio of octadecylamino group to cyclohexylamino group was 50/50.

The thus obtained diurea grease was subjected to tests for appraisal of the properties. The results are shown in Table 1.

COMPARATIVE EXAMPLE 4

29.0 g of bitolylenediisocyanate was added to 298 g of poly-α-olefin oil (8.2cSt at @210° F.) and was dissolved homogeneously. Into the resulting solution was added a homogeneous mixture of 23.0 g of cyclohexylamine dissolved in 150 g of poly-α-olefin oil and the resulting solution was stirred vigorously. Thus, a gel-like substance was yielded immediately. After agitating for 30 minutes, the temperature was raised to 120° C. and the gel-like substance was passed through a roll mill to produce a grease containing a diurea compound represented by the general formula of

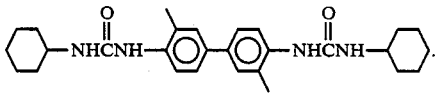

The content of the thickener was 10.4 wt. %.

24.7 g of bitolylenediisocyanate was separately charged in 282 g of the above poly-α-olefin oil and was dissolved homogeneously. Into this solution was added a homogeneous solution of 53.3 g of octyl alcohol in 140 g of the same poly-α-olefin oil and the resulting solution was agitated vigorously. Thus, a gel-like substance was produced immediately. After agitating for 30 minutes, the temperature was raised to 120° C. and the gel-like substance was passed through a roll mill to produce a grease containing a diurethane compound represented by the general formula of

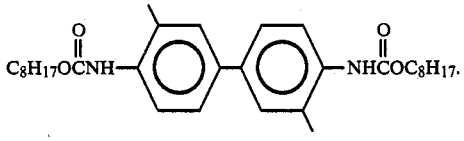

The content of the thickener was 15.6 wt. %.

The diurea and diurethane greases thus produced were mixed in a ratio of 1/1 to produce a product grease. The relative ratio of the yielded diurea compound the, urea-urethane compound and the diurethane compound was 40 mol%, 0 mol. % and 60 mol. %, respectively. The ratio of the cyclohexylamino group to octyloxy group was 40/60 and the content of the thickener was 13 wt. %.

The properties of the urea-urethane grease were appraised in the same way as in Example 1. The grease were appraised in the same way as in Example 1. The results are also shown in Table 1.

TABLE 1

| | Consistency | | | UW after | Dropping Point | Separtion of Oil (%) |
|---|---|---|---|---|---|---|
| | UW | 60 W | 100,000 W | One Week | (°C.) | 150° C. × 200 hr |
| Example 1 | 320 | 327 | 362 | 321 | 276 | 0.8 |
| Example 2 | 319 | 324 | 358 | 317 | 288 | 0.9 |
| Example 3 | 328 | 336 | 368 | 326 | 268 | 1.2 |
| Com. Ex. 1 | 289 | 297 | 381 | 295 | 207 | 1.5 |
| Com. Ex. 2 | 317 | 324 | 372 | 254 | 230 | 7 4 |
| Com. Ex. 3 | 305 | 316 | 340 | 230 | 273 | 0.7 |
| Com. Ex. 4 | 372 | >400 | >400 | 360 | 245 | 5.5 |

As will be apparent from the results of appraisal tests set forth in Table 1, the urea-urethane grease compositions of this invention have excellent properties in that the stability against shearing force is improved, that the dropping point is high, that the separation of oil at high temperature is only a little and that the hardening with the lapse of time is markedly decreased (in other words, the change in consistency with the lapse of time is small).

In contrast thereto, the commercially available Lisoap grease, Comparative Example 1, has a low dropping point and thus cannot be used at a high temperature. The commercially available tetraurea grease, Comparative Example 2, separates much oils at a high temperature. The diurea grease produced in accordance with the teaching of Japanese Patent Publication No. 11156/1980, Comparative Example 3, has a disadvantage that it becomes hard seriously with the lapse of time (in other words, the change in consistency with the lapse of time is large), although it has excellent stability against shearing force and a high dropping point, and only a little oil is separated at a high temperature. The mixture of the diurea and diurethane compounds not containing the urea-urethane compound according to the Comparative Example 4 has a deficiency that it has a lower ability in elevating the consistency. It should be thus clearly seen that the urea-urethane grease composition of the invention has the properties superior over those of the known grease compositions.

Although the present invention has been described with reference to the specific examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A urea-urethane grease composition comprising, as essential ingredients, a thickener and a lubricant base oil, said thickener containing a urea-urethane mixture having a composition including 20 to 95 mol. % of a diurea compound represented by the general formula (I) of:

$$R_2-NHC(=O)NH-R_1-NHC(=O)NH-R_2 \quad (I)$$

4 to 30 mol. % of a urea-urethane compound represented by the general formula (II) of:

$$R_2-NHC(=O)NH-R_1-NHC(=O)-O-R_3 \quad (II)$$

and 1 to 50 mol. % of a diurethane compound represented by the general formula (III) of:

$$R_3-O-C(=O)NH-R_1-NHC(=O)-O-R_3 \quad (III)$$

wherein $R_1$ represents a difunctional aromatic hydrocarbon residue having 6 to 15 carbon atoms, $R_2$ a cyclohexyl group or a group derived from cyclohexyl and having 7 to 12 carbon atoms and $R_3$ an alkyl group or an alkenyl group having 8 to 20 carbon atoms, the ratio of the numbers of amino groups $R_2$—NH— to those of alkoxy groups $R_3$—O— in said mixture being 95/5 to 40/60, said thickener being contained in an amount of 2 to 25 wt. % based on the total weight of the grease composition.

2. The urea-urethane grease composition according to claim 1, wherein said mixture of said diurea compound represented by the general formula of $$R_2-NHC(=O)NH-R_1-NHC(=O)-NH-R_2,$$

said urea-urethane compound represented by the general formula of $$R_2-NHC(=O)NH-R_1-NHC(=O)-O-R_3$$

and said diurethane compound represented by the general formula of $$R_3-O-C(=O)NH-R_1-NHC(=O)-O-R_3$$

is produced by reacting a diisocyanate represented by the general formula of OCN—$R_1$—NCO, a primary amine represented by the general formula of $R_2$—$NH_2$ and a higher alcohol represented by the formula of $R_3$—OH.

3. The urea-urethane grease composition according to claim 1, wherein $R_1$ in said general formulae (I) to (III) is selected from the group consisting of:

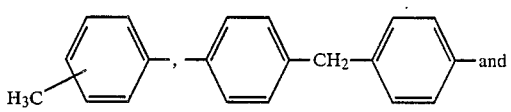

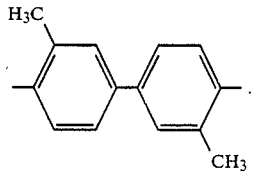

4. The urea-urethane grease composition according to claim 1, wherein $R_2$ in said general formulae (I) and (II) is selected from the group consisting of cyclohexyl, methylcyclohexyl, dimethylcyclohexyl, ethylcyclohexyl, diethylcyclohexyl, propylcyclohexyl, isopropylcyclohexyl, 1-methyl-3-propylcyclohexyl, butylcyclohexyl, amylcyclohexyl, amyl-methylcyclohexyl and hexylcyclohexyl.

5. The urea-urethane grease composition according to claim 1, wherein $R_3$ in said general formulae (II) and (III) is selected from the group consisting of octyl, nonyl, decyl, undecyl, dodecyl, tridecyl, tetradecyl, pentadecyl, hexadecyl, heptadecyl, octadecyl, octadecinyl, nonadecyl, eicosyl, octenyl, nonenyl, decenyl, undecenyl, dodecenyl, tridecenyl, tetradecenyl, pentadecenyl, hexadecenyl, hepatadecenyl, octadecenyl, nonadecenyl and eicosenyl.

6. The urea-urethane grease composition according to claim 1, wherein said lubricant base oil has a viscosity ranging within 2 to 40 cSt at @210° F.

7. The urea-urethane grease composition according to claim 2, wherein said diisocyanate, said primary amine and said higher alcohol are reacted in the presence of a volatile solvent.

8. The urea-urethane grease composition according to claim 7, wherein said volatile solvent is selected from the group consisting of benzene, toluene, xylene, hexane, naphtha, diisobutyl ether, carbon tetrachloride and petroleum ether.

9. The urea-urethane grease composition according to claim 2, wherein said diisocyanate, said primary amine and said higher alcohol are reacted in the presence of a lubricant base oil.

10. The urea-urethane grease composition according to claim 2, wherein said diisocyanate, said primary amine and said higher alcohol are reacted at a temperature of from 10° to 200° C.

* * * * *